US008834152B1

(12) United States Patent
Calvert

(10) Patent No.: US 8,834,152 B1
(45) Date of Patent: Sep. 16, 2014

(54) FIREARM FLAME THROWER COMBINATION

(71) Applicant: FFTC Associates, Manassas, VA (US)

(72) Inventor: S. Mill Calvert, Manassas, VA (US)

(73) Assignee: FFTC Associates, Manassas, VA (US)

( * ) Notice: Subject to any disclaimer, the term of this patent is extended or adjusted under 35 U.S.C. 154(b) by 0 days.

(21) Appl. No.: 14/261,196

(22) Filed: Apr. 24, 2014

(51) Int. Cl.
*F41H 9/02* (2006.01)
*F41C 27/00* (2006.01)
*F23Q 13/00* (2006.01)

(52) U.S. Cl.
CPC *F41H 9/02* (2013.01); *F41C 27/00* (2013.01); *F23Q 13/00* (2013.01)
USPC ..... 431/91

(58) Field of Classification Search
CPC ..... F41H 9/00; F41H 9/02; A01M 15/00
USPC ..... 431/91
See application file for complete search history.

(56) References Cited

U.S. PATENT DOCUMENTS

| | | | | | |
|---|---|---|---|---|---|
| 1,463,518 | A | | 7/1923 | Thomas | |
| 2,436,305 | A | * | 2/1948 | Johnson | 102/202.9 |
| 2,601,893 | A | * | 7/1952 | Funke | 431/91 |
| 2,653,552 | A | * | 9/1953 | Geeraet | 417/317 |
| 2,666,480 | A | | 1/1954 | Peterson et al. | |
| 2,971,573 | A | * | 2/1961 | Griffin et al. | 431/91 |
| 3,011,541 | A | * | 12/1961 | Sorensen | 89/1.11 |
| 3,016,086 | A | * | 1/1962 | Smith | 431/91 |
| 3,054,351 | A | * | 9/1962 | Apodaca et al. | 102/202.14 |
| 3,348,484 | A | * | 10/1967 | Grandy | 102/364 |
| 3,406,001 | A | | 10/1968 | Ishibashi | |
| 3,776,666 | A | * | 12/1973 | Ludwig | 417/411 |
| 3,872,769 | A | | 3/1975 | Rosling | |
| 4,220,443 | A | | 9/1980 | Bear | |
| 5,156,340 | A | * | 10/1992 | Lopes | 239/414 |
| 5,224,625 | A | * | 7/1993 | Holtier | 222/1 |
| 5,429,494 | A | * | 7/1995 | Kuehn | 431/91 |
| 7,226,284 | B2 | * | 6/2007 | Avelar | 431/33 |
| 7,779,576 | B2 | * | 8/2010 | Maas | 43/124 |
| 8,485,796 | B2 | * | 7/2013 | Gilpatrick | 417/313 |
| 8,689,697 | B2 | * | 4/2014 | Notomi | 102/444 |
| 2005/0082389 | A1 | * | 4/2005 | Sanchez et al. | 239/332 |
| 2006/0099540 | A1 | * | 5/2006 | Avelar | 431/35 |
| 2007/0281259 | A1 | * | 12/2007 | Clark | 431/75 |
| 2008/0127547 | A1 | * | 6/2008 | Maas | 43/124 |
| 2012/0233900 | A1 | * | 9/2012 | Notomi | 42/54 |

FOREIGN PATENT DOCUMENTS

| | | | | |
|---|---|---|---|---|
| GB | 601309 | A | * | 5/1948 |

* cited by examiner

*Primary Examiner* — Jorge Pereiro
(74) *Attorney, Agent, or Firm* — Louis Ventre, Jr.

(57) ABSTRACT

A firearm flame thrower combination includes a firearm, a cartridge that is dischargeable from the firearm; and a flame thrower attached to the firearm. The flame thrower has a battery; ignitable fluid; a reservoir holding the ignitable fluid; a nozzle that optionally pivots; a high-pressure pump operable to pump the ignitable fluid from the reservoir and to eject a stream of the ignitable fluid out of the nozzle. The stream is ignitable from muzzle flash exiting the muzzle upon firing of the cartridge in the firearm. Movement of the trigger may automatically activate the high-pressure pump. A radio-frequency controller may be used to emit a radio-frequency signal to start the high-pressure pump. An off switch may be included.

6 Claims, 2 Drawing Sheets

FIREARM FLAME THROWER COMBINATION

TECHNICAL FIELD

In the fields of combustion and weaponry, a muzzle-flash igniter, high-pressure pin-point flame thrower and firearm combination.

BACKGROUND ART

Flame throwers are well known devices to initiate field burns and to aid in military combat. Such devices are typically made for a single purpose of causing the projection of a broad sheet of flame to a target. Existing flame throwers are stand alone devices. Such flame throwers are typically heavy back-pack devices that enable ejecting large swaths of flammable fluid, rather than a thin stream of flammable fluid. Because of their weight and large quantities of flammable fluids typically thought to be necessary, they have not been combined with other hand carried weapons that are capable of independently firing a projectile.

Existing flame throwers are typically equipped with an igniter that ignites a combustible fluid being hurled at a target. No existing flame throwers are also combined with a rifle so that the igniter is muzzle flash. No existing flame thrower provides a structure where the flammable fluid ejected from the flame thrower can be ignited as a consequence of firing a firearm. A structural combination enabling a muzzle-flash igniter is new. Existing flame throwers are not combined with a rifle nor are they ignitable with muzzle flash of a weapon.

SUMMARY OF INVENTION

A firearm flame thrower combination is a weapon system that includes a rifle or pistol, a cartridge that is dischargeable from the firearm; and a flame thrower attached to the firearm. The flame thrower has a battery; ignitable fluid; a reservoir holding the ignitable fluid; a nozzle; a high-pressure pump operable to pump the ignitable fluid from the reservoir and to eject a stream of the ignitable fluid out of the nozzle. The stream is ignitable from muzzle flash exiting the muzzle upon firing of the cartridge in the firearm. An electrical connection between the trigger and the high-pressure pump may be used to cause automatic activation of the high-pressure pump upon movement of the trigger away from its initial position. A radio-frequency controller may be used to emit a radio-frequency signal when activated and to receive that radio-frequency signal to start the high-pressure pump. An off switch may be included to prevent operability of the high-pressure pump. A pivot joint is operable to rotate the nozzle so that the direction of the stream of ignitable fluid may be adjusted with respect to its alignment with the barrel.

Technical Problem

In combat and law enforcement situations, many times a bullet by itself is not sufficient to accomplish the task at hand. A bullet may not take down an enemy because he may be wearing a considerable amount of body armor or he may be partially obstructed by a pile of debris he is hiding behind. A bullet may not intimidate or scare an enemy at all because he may be moving and believes there is little chance that he will be hit in a vital area. The enemy may be in an armored vehicle or bunker and be shooting his gun out of a slot or small opening. The enemy may be driving a car in a drive-by shooting and will not surrender because he has little chance of being shot if he accelerates away. There are many different situations that can arise when a bullet shot at an enemy will not do the job of convincing him to surrender or stopping him.

Old Word War II footage of soldiers showed that flame throwers caused absolute terror in the enemy soldiers even when they were in a trench or bunker. The devastation and fear caused by the presence of flame thrower caused the enemy to lay down their guns and surrender instead of chancing a painful death of being burned alive. The flame throwers of this bygone era were big, heavy and bulky contraptions that were hard to maneuver around. They had big tanks, so the flame thrower could be used over and over again on large groups of enemy soldiers.

If only there was a way to take the terror of a flame thrower and miniaturize it so it could work in conjunction with a rifle or a pistol. This would give our military and law enforcement personnel a great ability to convince our enemies to surrender, or take them down and accomplish the task at hand.

Solution to Problem

One thing that does instill great fear and intimidates even the bravest of the enemy is the thought of being burned alive and the unbearable pain that it causes as flesh begins to burn off the body while still conscious.

5[0009] The invention of the firearm flame thrower combination has now given our military the ability to combine the terror and functionality of a flame thrower along with a bullet that is fired from a weapon. This will have profound impact on protecting our soldiers and quickly winning military or law enforcement confrontations.

The firearm flame thrower combination works by having a small, compact flame thrower unit that mounts onto the gun below the barrel. It has a high pressure pump that can shoot out a jet stream of flame thrower solution toward the target where the gun is aimed.

The firearm flame thrower combination is preferably battery operated and has a capsule of flame thrower solution that can be easily changed in a few seconds by popping out an empty capsule and inserting a full capsule. The unit has both manual push buttons on the side to operate it and radio-frequency controls that can work from a remote or trigger remote. There are several ways the unit can be used. The soldier can just soak the clothes of the enemy without igniting the solution and convince him to surrender before he becomes a human torch. The soldier can shoot out the stream of solution and then fire his weapon, which will cause the muzzle flash to ignite the solution and the enemy will be laying on the ground bleeding with a gunshot wound while a roaring fire is cremating him. The soldier can also use the flame thrower unit independently without needing the muzzle flash to ignite the solution by using the button igniter on the unit.

Advantageous Effects of Invention

If an enemy is wearing lots of body armor, this will no longer protect him as he becomes a human torch. If he is hiding behind a pile of debris, he will have no shelter as the debris becomes a roaring fire. If he is moving, he will know that the flame thrower will get him even if the small bullet misses. If he is shooting out of a slot in a bunker, or from an armored vehicle, he will know that the liquid jet stream can penetrate the slot and cook him alive. He will not be driving away after his drive by shooting since the inside of his car will now be a raging inferno.

The firearm flame thrower combination brings the great fear and terror and functionality of a flame thrower to a level where it can now work in conjunction with a small arm, such as a rifle or pistol. This will provide law enforcement and military personnel a very valuable and needed tool to accomplish their task at hand. This technology will protect our bravest and finest, and result in many more surrenders instead of firefights because no enemy even wants to think about the horrors and pain of being burnt alive and cremated while conscious.

BRIEF DESCRIPTION OF DRAWINGS

The drawings illustrate preferred embodiments of the firearm flame thrower combination according to the disclosure. The reference numbers in the drawings are used consistently throughout. New reference numbers in FIG. 2 are given the 200 series numbers. Similarly, new reference numbers in each succeeding drawing are given a corresponding series number beginning with the figure number.

DESCRIPTION OF EMBODIMENTS

In the following description, reference is made to the accompanying drawings, which form a part hereof and which illustrate several embodiments of the present invention. The drawings and the preferred embodiments of the invention are presented with the understanding that the present invention is susceptible of embodiments in many different forms and, therefore, other embodiments may be utilized and structural, and operational changes may be made, without departing from the scope of the present invention.

Figure 1:
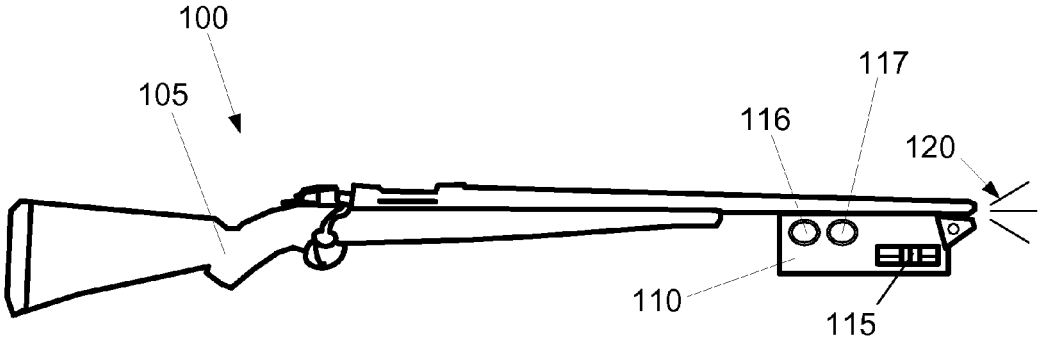
FIG. 1 is a side elevation view of a preferred embodiment of the firearm flame thrower combination.
Figure 3:
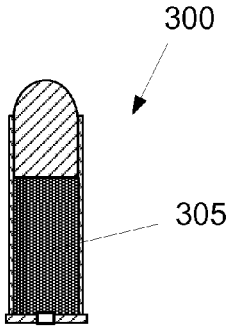
FIG. 3 is a sectional elevation view of a cartridge for the firearm in the firearm flame thrower combination shown in FIG. 1.
Figure 4:
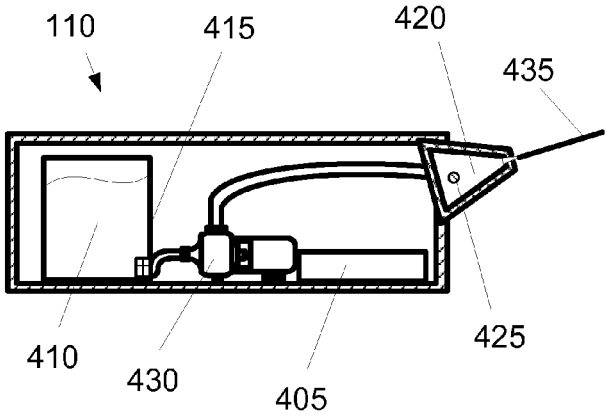
FIG. 4 is a sectional elevation view of a flame thrower for one embodiment of the firearm flame thrower combination.
Figure 5:
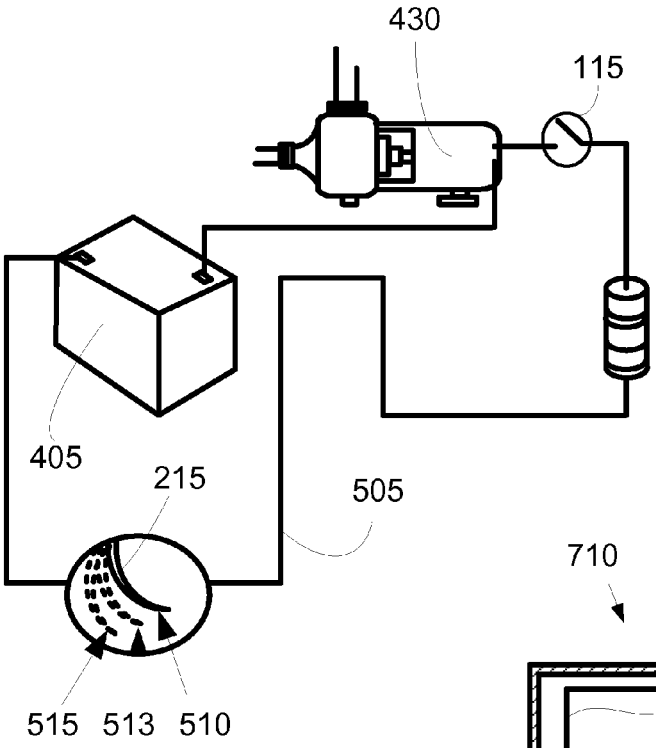
FIG. 5 is a circuit diagram for one embodiment of the firearm flame thrower combination.

A weapon system (100), as illustrated in FIG. 1 and FIG. 3, includes a firearm (105), a cartridge (300) that is dischargeable from the firearm (105); and a flame thrower (110) that is attached to the firearm (105). In the drawings, a firearm (105) is represented by a rifle. This is for convenience only and to avoid complexity in the description. A firearm (105) is defined to include a pistol, a rifle, or any weapon (including a starter gun), which will, or is designed to or may readily be converted to expel a projectile by the action of a propellant. Preferably, a firearm, as used herein, is a portable gun, being a barreled weapon that is capable of launching one or more projectiles often defined by the action of a propellant. A propellant is also referred to as an explosive.

Figure 2:
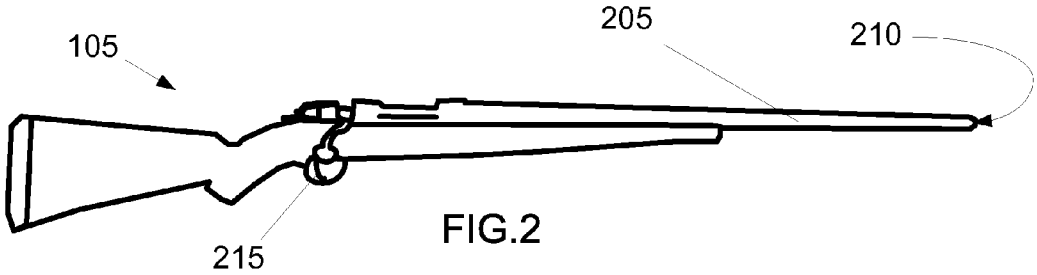
FIG. 2 is a side elevation view of the firearm in the firearm flame thrower combination shown in FIG. 1.

FIG. 2 shows the firearm (105) to include a trigger (215) and a muzzle (210). The firearm (105) has a barrel (205), which is a firing cylinder. The firearm (105) will also typically have a firing chamber, which for a rifle or a semi-automatic pistol is the internal portion of the barrel (205) in which the cartridge (300) is inserted prior to being fired. For a revolver, the firing chamber is in a revolving cylinder containing multiple chambers.

The cartridge (300) is defined to include any round or shell dischargeable from the firearm (105). The cartridge (300) may include a blank, which is a cartridge without a bullet. The cartridge (300) necessarily includes propellant (305), and may also include a bullet and a primer. The cartridge (300) is typically made with a metallic, paper, or plastic case that is sized to fit within the firing chamber of the firearm (105). When the propellant (305) is ignited when the cartridge (300) is fired from the firearm (105), muzzle flash (120) exits the muzzle (210) of the firearm (105) and it is the muzzle flash (120) that ignites a stream (435) of ignitable fluid (410) exiting the nozzle (420) in the flame thrower (110).

The flame thrower (110) is a mechanical incendiary device designed to project a a stream (435), preferably a long, controllable stream, of ignitable fluid (410) that is lit with muzzle flash (120) from the firearm (105) when the cartridge (300) in the chamber is discharged. The stream (435) is initiated when the trigger (215) on the rifle is moved or pulled. Preferably, the stream begins with slight movement of the trigger before the trigger is pulled far enough to fire the cartridge. In this manner, a shooter might start the stream (435) first by a halfway pull of the trigger (215) and then take aim and fire the cartridge (300) with a bullet at the target as the stream (435) is continued. If the trigger (215) is pulled to less than that required to fire the cartridge (300), for example to a half-way position (513), then the shooter can move the barrel (205) up or down, and hence the nozzle (420) up or down, to make the stream (435) reach the target. When the target is soaked, then the shooter can re-aim the firearm (105) and shoot, which generates muzzle flash (120) that ignites the stream (435). When the trigger (215) is released, the stream (435) is halted.

A battery (405) provides power to the flame thrower (110) and control circuit that operates the weapon system (100). The battery (405) is broadly defined to mean a power source. The battery (405) is preferably comprised of electrochemical cells that transform chemical energy into electricity. For purposes of this disclosure the battery (405) includes a capacitor, which can store electric energy when disconnected from its charging circuit.

The ignitable fluid (410) is preferably a petroleum-based fuel, such as gasoline or petrol possibly with thickeners. An alcohol, such as ethanol, methonol, and butanol, are other examples of an ignitable fluid (410).

A reservoir (415) holds the ignitable fluid (410). The reservoir (415) is a replaceable capsule or cartridge. The reservoir (415) may be two separate units that hold different chemicals that become combustible when mixed together to form the stream (435) being ejected from a nozzle (420) in the flame thrower (110). The nozzle (420) is preferably on a pivot joint (425) so that the shooter can adjust the inclination of the stream (435) for targets at various distances. Thus, the weapon system (100) may include a pivot joint (425) operable to rotate the nozzle (420) so that the stream (435) of ignitable fluid (410) may be adjusted with respect to its direction and alignment with the barrel (205). Rotation of the nozzle (420) may be manual or automatic depending on feedback from a targeting lens, a distance measuring device or a central processing unit included to control the flame thrower (110) operations.

The stream (435) is created by activation of a high-pressure pump (430) when the trigger (215) is moved or some other activation mechanism is manually engaged. Preferably, there is an electrical connection (505) between the trigger (215) and a high-pressure pump (430). The electrical connection (505) causes automatic activation of the high-pressure pump (430) upon movement of the trigger (215) away from its initial position (510) toward a firing position (515). The high-pressure pump (430) may alternatively be activated by a radio-frequency controller (605). The radio-frequency controller (605) is a two part system comprising a signal generator, which generates a radio-frequency signal (610), and a signal receiver which receives a radio-frequency signal (610) and activates or deactivates a component, which in this case is the high-pressure pump (430). The signal generator may be activated by a touch sensor on the firearm (105), including a button, by trigger (215) movement, or by a remote, similar to a garage door opener.

The high-pressure pump (430) is operable to pump the ignitable fluid (410) from the reservoir (415) and to eject the stream (435) of the ignitable fluid (410) out of the nozzle (420). The stream (435) being ignitable from muzzle flash (120) exiting the muzzle (210) upon firing of the cartridge (300) in the firearm (105). The high-pressure pump (430) need not produce a large flow of flammable fluid, but rather, it is preferably to produce only a thin stream of about one-eighth of an inch in diameter, which is considered sufficient to wet the target to cause it to burn. Miniature high-speed motors and miniature, low weight, high-pressure pumps capable of producing such a stream (435) are commercially available.

The weapon system (100) may also include an off switch (115) to prevent operability of the high-pressure pump (430). In alternative embodiments, the weapon system (100) has a manual spray-on button (116) to operate the flame thrower (110) manually without using the trigger (215) or the radio-frequency controller (605). The manual spray-on button (116) turns on the high-pressure pump (430) either for a fixed period of time or as long as the manual spray-on button (116) is depressed. For this embodiment the flame thrower (110) also has an igniter button (117) to light the stream (435). The igniter button (117) is connected to a spark generator near where the stream (435) exits the nozzle (420). The spark generator may be connected to the battery (405) or may be a piezoelectric spark generator as is commonly found on back yard barbeques. For this embodiment, the soldier can use the flame thrower (110) independently of the firearm (105) without needing the muzzle flash (120) to ignite the solution by using the igniter button (117) on the flame thrower (110).

Figure 7:
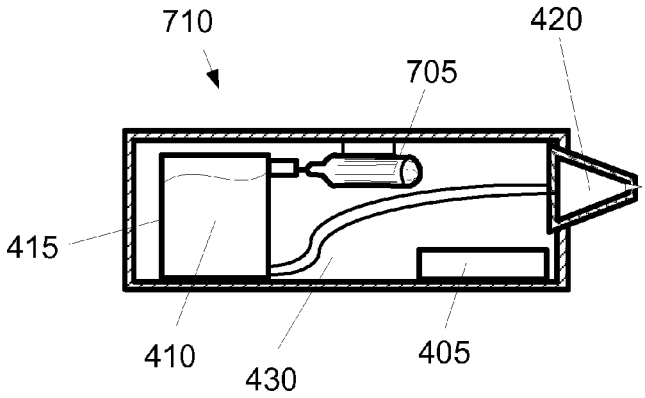
FIG. 7 is a sectional elevation view of an alternative flame thrower for an embodiment of the firearm flame thrower combination.
Figure 6:
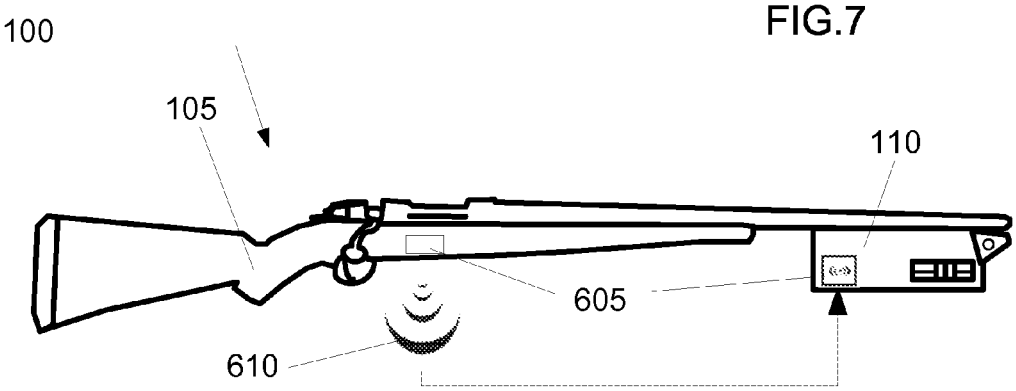
FIG. 6 is a side elevation view of the firearm flame thrower combination where the flame thrower is operable by a radio-frequency controller activated by trigger movement.

In an alternative embodiment, the high-pressure pump (430) is replaced by a compressed gas source (705), shown in FIG. 7, which motivates the ejection of the ignitable fluid. Examples of a compressed gas source are compressed gas cylinders or simply a compressed gas reservoir. Compressed gas technologies are well known applications in high-pressure water guns, which can deliver a stream of water up to about 14 meters (~45 feet) away. For this embodiment, the weapon system (100) comprises a firearm (105), a cartridge (300) that is dischargeable from the firearm (105); and an alternative flame thrower (710) attached to the firearm (105), the firearm (105) comprising a trigger (215) and a muzzle (210); the cartridge (300) comprising a propellant (305); the alternative flame thrower (710) comprising: an ignitable fluid (410); a reservoir (415) holding the ignitable fluid (410); a nozzle (420); the compressed gas source (705) operable to push the ignitable fluid (410) from the reservoir (415) and to eject a stream (435) of the ignitable fluid (410) out of the nozzle (420), the stream (435) ignitable from muzzle flash (120) exiting the muzzle (210) upon firing of the cartridge (300) in the firearm (105). A battery (405) may also be used to power opening and closing valves linked to trigger (215) movement.

The above-described embodiments including the drawings are examples of the invention and merely provide illustrations of the invention. Other embodiments will be obvious to those skilled in the art. Thus, the scope of the invention is determined by the appended claims and their legal equivalents rather than by the examples given.

INDUSTRIAL APPLICABILITY

The invention has application to the weapons industry.

What is claimed is:

1. A weapon system comprising:
a firearm comprising a barrel, a trigger and a muzzle;
a cartridge that is dischargeable from the firearm;
a flame thrower unit suspended from the barrel;
the cartridge comprising a propellant; and
the flame thrower unit comprising:
an ignitable fluid;
a reservoir holding the ignitable fluid;
a nozzle; and
a compressed gas source operable to push the ignitable fluid from the reservoir and to eject a stream of the ignitable fluid out of the nozzle, the stream ignitable from muzzle flash exiting the muzzle upon firing of the cartridge in the firearm.

2. A weapon system comprising:
a firearm comprising a barrel, a trigger and a muzzle;
a cartridge that is dischargeable from the firearm;
a flame thrower unit suspended from the barrel;
the cartridge comprising a propellant; and
the flame thrower unit comprising:
a battery;
ignitable fluid;
a reservoir holding the ignitable fluid;
a nozzle; and
a high-pressure pump operable to pump the ignitable fluid from the reservoir and to eject a stream of the ignitable fluid out of the nozzle, the stream ignitable from muzzle flash exiting the muzzle upon firing of the cartridge in the firearm.

3. The weapon system of claim 2, further comprising an electrical connection between the trigger and the high-pressure pump, said electrical connection causing automatic activation of the high-pressure pump upon movement of the trigger away from its initial position.

4. The weapon system of claim 2, further comprising a radio-frequency controller operable to emit a radio-frequency signal when activated and to receive that radio-frequency signal to start the high-pressure pump.

5. The weapon system of claim 2, further comprising an off switch to prevent operability of the high-pressure pump.

6. The weapon system of claim 2, wherein the firearm further comprises a barrel; and the weapon system further comprises a pivot joint operable to rotate the nozzle so that the stream of the ignitable fluid may be adjusted with respect to its direction and alignment with the barrel.

* * * * *